United States Patent [19]

Victor

[11] 4,425,675

[45] Jan. 17, 1984

[54] HEAD REST AND SUNSHADE CONSTRUCTION

[76] Inventor: Johannes J. A. Victor, P.O. Box 3462, Cape Town 8000, South Africa

[21] Appl. No.: 279,172

[22] Filed: Jun. 30, 1981

[51] Int. Cl.[3] ..... A47G 9/00

[52] U.S. Cl. ..... 5/440; 5/418; 5/434

[58] Field of Search ..... 5/418, 419, 431, 434, 5/436, 437, 440, 442

[56] References Cited

U.S. PATENT DOCUMENTS

| | | | |
|---|---|---|---|
| 1,764,757 | 6/1930 | Slee | 5/419 |
| 2,839,766 | 6/1958 | Hull | 5/436 |
| 2,910,707 | 11/1959 | Lawser | 5/419 |
| 2,932,833 | 4/1960 | Wambach | 5/434 |
| 3,148,386 | 9/1964 | Shebib | 5/440 |
| 3,241,160 | 3/1966 | Escobar | 5/440 |
| 3,298,477 | 1/1967 | Martinez | 5/437 |
| 3,359,577 | 12/1967 | Rogers | 5/431 |
| 4,100,633 | 7/1978 | Pintos | 5/434 |

*Primary Examiner*—Alexander Grosz
*Assistant Examiner*—Michael F. Trettel
*Attorney, Agent, or Firm*—William R. Hinds

[57] ABSTRACT

A head rest and sunshade construction comprising in combination: a base consisting of an inclined upper panel having an upper face, and side support panels adapted to support the upper panel on a surface; a cushion member provided on the upper panel so as to project above the upper face of the upper panel; a sunshade having a support frame and a cover attached thereto; and adjustable support means for adjustably supporting the support frame on the base.

6 Claims, 5 Drawing Figures

HEAD REST AND SUNSHADE CONSTRUCTION

BACKGROUND OF THE INVENTION

1. Field of the invention

The present invention relates to a head rest and sunshade construction.

More particularly the invention relates to a head rest and sunshade construction which is of particular use on beaches or at swimming pools to support the head of a user when in a reclined position, and simultaneously to protect the user's face from sunrays.

2. Description of the prior art

A number of head rest and sunshade constructions are known in the prior art. These constructions or devices have various forms, shapes and configurations. For example, U.S. Pat. No. 4,063,318 illustrates a folding frame assembly which has a headrest supported by a folding frame and a cover sheet held at a distance by the folding frame from the headrest. An involved folding system is provided so as to fold the device into a small collapsible form for transportation purposes. Another type of headrest and sunshade is disclosed in U.S. Pat. No. 2,932,833. Here a cushion type base is provided with an adjustable headrest.

In U.S. Pat. Specification No. 2,738,249 a carrying case combined with a headrest and shade is shown. The case at one side supports a headrest and the lid of the case folds out so as to provide the headrest.

All of the prior specifications disclose constructions which are relatively complicated, and which do not fully provide a shape which ensures a comfortable support to a user's neck.

It is an object of the invention to suggest an alternative head rest and sunshade construction which will assist in providing a relatively simplified construction and a more comfortable and practical use to a user.

BRIEF DESCRIPTION OF INVENTION

According to the invention, a head rest and sunshade construction comprises in combination:

(a) a base consisting of an inclined upper panel having an upper face, and side support panels adapted to support the upper panel on a surface (e.g. soil, a beach or a grass lawn);

(b) a cushion member provided on the upper panel so as to project above its upper face;

(c) a sunshade having a support frame and a cover attached thereto; and (d) adjustable support means for adjustably supporting the support frame on the base.

The upper panel may be curved at least partially downwardly away from its upper face and towards a surface on which it is to be supported.

The base may be of substantially triangular shape in longitudinal cross-section.

The side support panels of the base may include two longitudinal side panels, a rear panel, a front panel, and a floor panel so that the base constitutes a hollow box-like configuration.

The floor panel may have an opening through which articles may be inserted into the base for storage purposes.

The support frame of the sunshade may include a number of radial adjustable arms provided on each side of the upper panel and which are joined at one end to the upper panel by means of the adjustable support means, and cross-arms joining the other ends of the two sets of radial arms and supporting the cover.

The adjustable support means may include a bolt for each side of the base and attached thereto, and a wing-nut co-operating therewith for tightening the radial arms in any desired position.

DESCRIPTION OF DRAWINGS

The invention will now be described by way of example with reference to the accompanying schematic drawings.

In the drawings there is shown in

Figure 1:
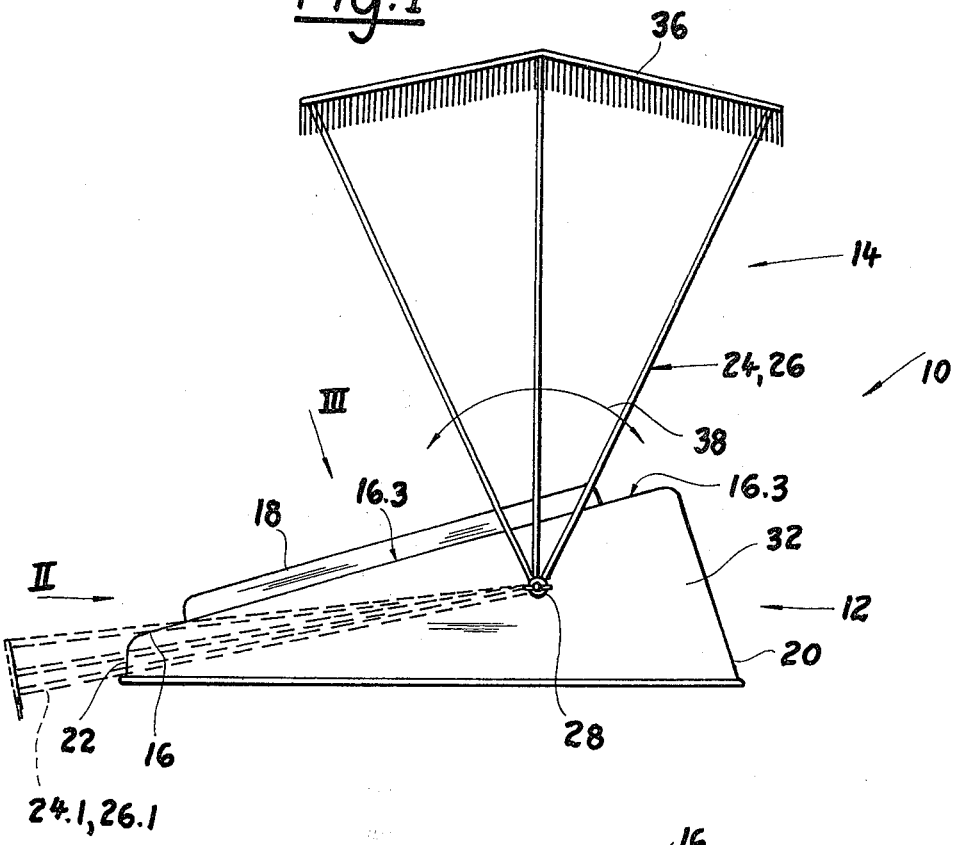
FIG. 1 a side view of a head rest and sunshade construction in accordance with the invention.

As shown in the drawings, the head rest and sunshade construction 10 basically includes a base 12 and a sunshade 14.

The base 12 is in the form of a hollow box and is made of any suitable material, such as fibre glass. It has an upper panel 16 which is inclined and which has a recess 16.1 for receiving a cushion 18. The base 12 further has a rear wall 20 and a front wall 22. The rear wall 20 is higher than the front wall 22 so that seen from the side the base 12 is of substantially triangular shape.

Figure 4:
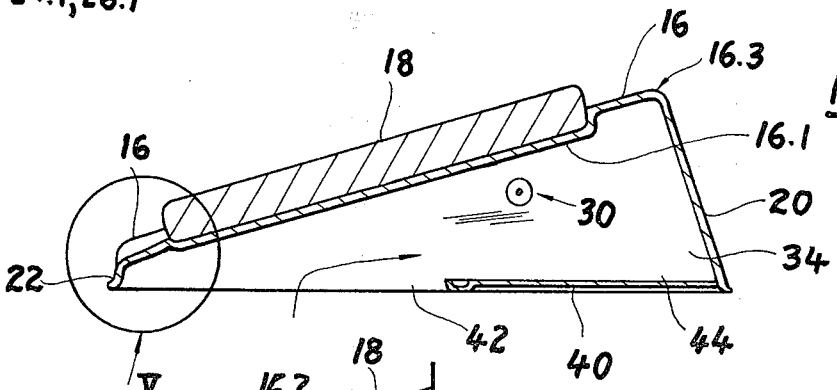
FIG. 4 a sectional side view of the head rest seen along arrows IV—IV in FIG. 3.
Figure 5:
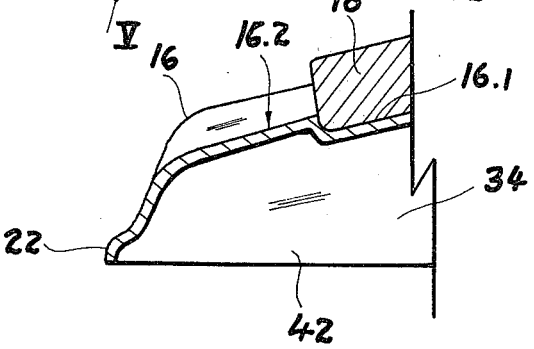
FIG. 5 on a larger scale, a sectional side view of a part of the construction indicated by the circle V in FIG. 4.
Figure 2:
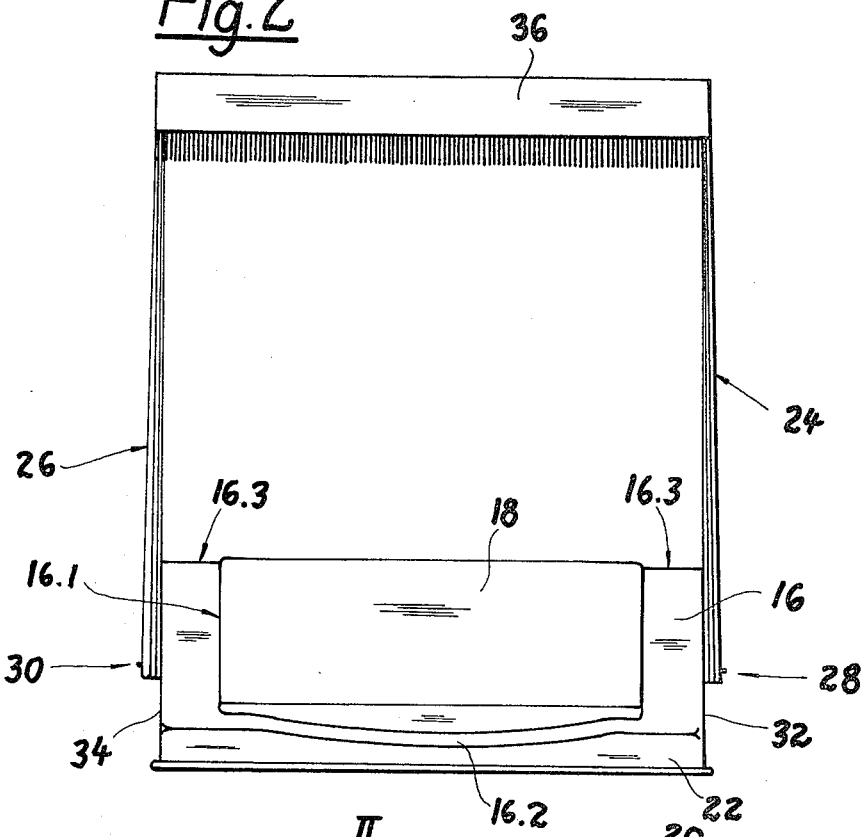
FIG. 2 a front view of the construction seen along arrow II in FIG. 1.
Figure 3:
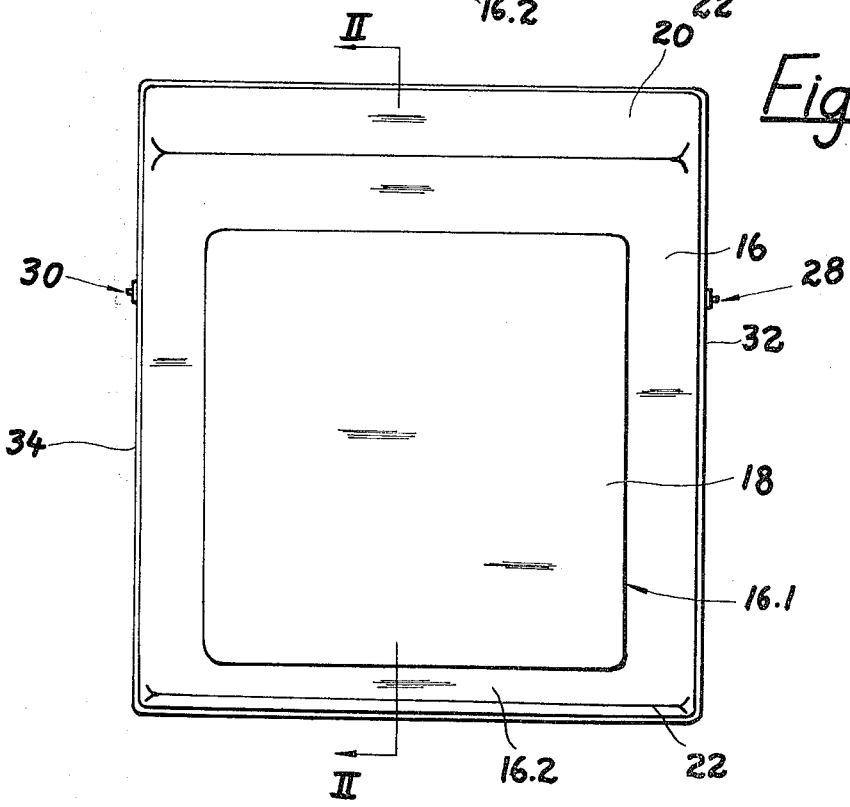
FIG. 3 a plan view of the construction seen along arrow III in FIG. 1 but with the sunshade removed.

The lower front part of the upper panel 16 is curved downwardly when seen from the front and as can be seen in FIGS. 2 and 4. This curvature 16.2 ensures that a user, when in the reclined position with his head resting on the cushion 18, will have a comfortable position for his neck. The remaining parts 16.3 of the upper panel 16 are flat as can be seen in FIGS. 2 and 4.

The sunshade 14 includes two sets of radial arms 24, 26, each of which being mounted by means of a bolt and wing nut arrangements 28, 30 on the side walls 32 and 34 of the base 12. These arms 24, 26 may be moved closer together or further apart depending on the area and the location of shade required. Their position relative to the base 12 may also be adjusted. At their free ends the arms 24, 26 support a cover in the form of a flexible sheet 36, which may be made of canvas, plastics sheeting or any other suitable sheet material. The arms 24, 26 may be moved as indicated by arrow 38 in FIG. 1 so that they may be moved towards the cushion 18 or away therefrom in order to obtain the correct position for throwing shade onto the cushion 18, where the head of a person rests.

The sunshade 14 therefore can be used to provide protection against sunlight, or any other light rays.

When transported, the arms 24, 26 are moved against the base 12 as indicated by dotted lines 24.1, 26.1 in FIG. 1 so that they can act as a U-shaped handle for a compact transportable unit.

The base 12 further has a floor panel 40, which does not cover the full length of the base 12 so that an insertion opening 42 is defined between the free edge of the panel 40 and the front wall 22. Therefore a pocket or chamber 44 is provided inside the hollow base 12. Articles may be inserted through the opening 42 into the pocket 44 (as indicated by arrow 46 in FIG. 4) for storage or transportation purposes.

I claim:

1. A head rest and sunshade construction comprising in combination:

(a) a base consisting of an inclined upper panel having an upper face, and side support panels adapted to support the upper panel on a surface, said side support panels of the base including two longitudinal side panels, a rear panel, a front panel, and a floor panel so that the base constitutes a hollow boxlike configuration;

(b) a cushion member provided on the upper panel so as to project above the upper face of the upper panel;

(c) a sunshade having a support frame and a cover attached thereto; and (d) adjustable support means for adjustably supporting the support frame on the base.

2. A construction as claimed in claim 1, in which the upper panel is curved at least partially downwardly away from its upper face and towards a surface on which it is to be supported.

3. A construction as claimed in claim 1, in which the base is of substantially triangular shape in longitudinal cross-section.

4. A construction as claimed in claim 1, in which the floor panel has an opening through which articles may be inserted into the hollow base for storage purposes.

5. A construction as claimed in claim 1, in which the support frame of the sunshade includes a number of radial adjustable arms provided on each side of the upper panel and which are joined at one end to the upper panel by means of the adjustable support means, and cross-arms joining the other ends of the two sets of radial arms and supporting the cover.

6. A construction as claimed in claim 5, in which the adjustable support means includes a bolt for each side of the base and attached thereto, and a wingnut co-operating therewith for tightening the radial arms in any desired position.

* * * * *

UNITED STATES PATENT AND TRADEMARK OFFICE

CERTIFICATE OF CORRECTION

PATENT NO. : 4,425,675

DATED : January 17, 1984

INVENTOR(S) : Johannes J. A. Victor

It is certified that error appears in the above-identified patent and that said Letters Patent is hereby corrected as shown below:

On the title page Insert:

-- (30) Foreign Application Priority Data

September 5, 1980 South Africa 80-5512 --

Signed and Sealed this

*Seventeenth* Day of *July 1984*

[SEAL]

*Attest:*

GERALD J. MOSSINGHOFF

*Attesting Officer*

*Commissioner of Patents and Trademarks*